US010731874B2

(12) United States Patent
Koike et al.

(10) Patent No.: US 10,731,874 B2
(45) Date of Patent: Aug. 4, 2020

(54) DIFFUSER AND BELLMOUTH FOR AN OUTDOOR UNIT FAN CASING

(71) Applicant: DAIKIN INDUSTRIES, LTD., Osaka (JP)

(72) Inventors: Fumiaki Koike, Osaka (JP); Shigeki Kamitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/097,089

(22) PCT Filed: Apr. 21, 2017

(86) PCT No.: PCT/JP2017/015998
§ 371 (c)(1),
(2) Date: Oct. 26, 2018

(87) PCT Pub. No.: WO2017/188134
PCT Pub. Date: Nov. 2, 2017

(65) Prior Publication Data

US 2019/0107297 A1 Apr. 11, 2019

(30) Foreign Application Priority Data

Apr. 27, 2016 (JP) ..... 2016-089212

(51) Int. Cl.
*F24F 1/38* (2011.01)
*F24F 13/20* (2006.01)
(Continued)

(52) U.S. Cl.
CPC ..... *F24F 1/38* (2013.01); *F24F 1/50* (2013.01); *F24F 1/56* (2013.01); *F24F 13/20* (2013.01); *F24F 2013/205* (2013.01)

(58) Field of Classification Search
CPC ..... F24F 1/56; F24F 2013/205; F24F 13/20; F24F 1/38; F24F 1/50
See application file for complete search history.

(56) References Cited

U.S. PATENT DOCUMENTS 4,454,641 A 6/1984 Haas et al.
7,014,423 B2 * 3/2006 Parker ..... F04D 29/325 415/220

(Continued)

FOREIGN PATENT DOCUMENTS

EP 2889544 A1 7/2015
JP S61-104160 U 7/1986

(Continued)

OTHER PUBLICATIONS

International Search Report issued in corresponding International Application No. PCT/JP2017/015998 dated Jul. 25, 2017, with translation (5 pages).

(Continued)

*Primary Examiner* — Filip Zec
(74) *Attorney, Agent, or Firm* — Osha Liang LLP

(57) ABSTRACT

An outdoor unit for a refrigeration cycle apparatus includes: a fan; a bellmouth that covers a periphery of the fan; a casing that internally houses the fan and the bellmouth so that airflow faces upward and that has a top end edge having a flat shape; and a diffuser surface disposed below a top end edge of the casing but above a top end of the bellmouth and on the outer side relative to the top end of the bellmouth in plan view, wherein the diffuser surface is inclined to extend outward away from the rotation axis of the fan as getting upward. The casing has a plurality of side surfaces that cover the sides of the bellmouth. At least one of the side surfaces has a recessed shape toward the bellmouth so that a gap with the top end edge of the bellmouth is reduced.

6 Claims, 13 Drawing Sheets

(51) Int. Cl.
*F24F 1/50* (2011.01)
*F24F 1/56* (2011.01)

(56) References Cited

U.S. PATENT DOCUMENTS

| | | | | |
|---|---|---|---|---|
| 2009/0193831 | A1* | 8/2009 | Kim | F04D 29/526 62/259.1 |
| 2013/0125579 | A1 | 5/2013 | Okazawa | |
| 2016/0281739 | A1* | 9/2016 | Nakagawa | F04D 29/544 |
| 2017/0102007 | A1* | 4/2017 | Stauter | F04D 29/547 |

FOREIGN PATENT DOCUMENTS

| | | | |
|---|---|---|---|
| JP | H5-157288 | A | 6/1993 |
| JP | 2005-127578 | A | 5/2005 |
| JP | 2006077585 | A | 3/2006 |
| JP | 2006-138268 | A | 6/2006 |
| JP | 2008-232536 | A | 10/2008 |
| JP | 2009-103353 | A | 5/2009 |
| JP | 2014-129921 | A | 7/2014 |
| JP | 2015-081691 | A | 4/2015 |
| JP | 2015-129504 | A | 7/2015 |
| WO | 2012017483 | A1 | 2/2012 |
| WO | 2012/035577 | A1 | 3/2012 |
| WO | 2015083371 | A1 | 6/2015 |

OTHER PUBLICATIONS

Written Opinion of the International Searching Authority issued in corresponding International Application No. PCT/JP2017/015998 dated Jul. 25, 2017 (5 pages).

Office Action issued in corresponding Japanese Patent Application No. 2016-089212 dated Jul. 14, 2017 (9 pages).

Notification of Transmittal of Translation of the International Preliminary Report on Patentability for International Application No. PCT/JP2017/015998, dated Nov. 8, 2018 (1 page).

International Preliminary Report on Patentability issued in corresponding International Application No. PCT/JP2017/015998, dated Nov. 8, 2018 (8 pages).

Extended European Search Report issued in European Application No. 17789417.7, dated on Apr. 10, 2019 (7 pages).

* cited by examiner

DIFFUSER AND BELLMOUTH FOR AN OUTDOOR UNIT FAN CASING

TECHNICAL FIELD

The present invention relates to an outdoor unit of a refrigeration cycle apparatus.

BACKGROUND

Conventionally there has been proposed an up-flow type outdoor unit provided with a fan installed so as to blow air upward and a casing accommodating the fan therein.

For example, in the up-blow type outdoor unit described in Japanese Patent Document 1 (Japanese Unexamined Patent Application No. 2014-129921), the top end of the casing accommodating the fan is configured to be flat and positioned on substantially the same plane.

For this reason, when for example storing a plurality of the outdoor units in a warehouse, it is easy to arrange one or a plurality of the outdoor units on the outdoor unit so as to be vertically stacked, and moreover possible to stabilize the stacked arrangement.

Here, the up-flow type outdoor unit described in Patent Document 1 has a structure in which a large flow passage that is rectangular in plan view, due to being enclosed by side plates, continues on the outlet side of the bellmouth. According to this structure, immediately after passing through the bellmouth, the flow passage area rapidly enlarges.

However, at the portion where the flow passage area is suddenly enlarged, air vortices are generated at the side of the enlarged portion, which could inhibit good airflow and thereby prevent the air volume in the outdoor unit from being sufficiently increased.

SUMMARY

One or more embodiments of the present invention provide an outdoor unit of a refrigeration cycle apparatus that is easily arranged so as to be vertically stacked and can enable an increase in air volume.

An outdoor unit of a refrigeration cycle apparatus according to one or more embodiments is provided with a fan; a bellmouth; a casing, and a diffuser surface. The bellmouth covers the periphery of the fan. The casing houses the fan and the bellmouth so that the airflow faces upward. The top end edge of the casing has a flat shape. The diffuser surface is provided below the top end edge of the casing but above the top end of the bellmouth and on the outer side relative to the top end of the bellmouth in plan view. The diffuser surface is inclined so as to separate outward away from the rotation axis of the fan heading upward.

It should be noted that the diffuser surface is not particularly limited provided the diffuser surface is below the top end edge of the casing but above the top end of the bellmouth, on the outer side relative to the top end of the bellmouth in plan view, and inclined so as to separate outward away from the rotation axis of the fan heading upward. The diffuser surface may be constituted such that a plurality of surfaces with different tilt angles are continuous, or may be curved surface. Further, in the diffuser surface, the surface that is below the top end edge of the casing but above the top end of the bellmouth, on the outer side relative to the top end of the bellmouth in plan view, and inclined so as to separate outward away from the rotation axis of the fan heading upward does not need to be provided so as to continuously spread out in the direction in which the rotation shaft of the fan extends. For example, a plurality of diffuser surfaces may be provided such that there exists a plurality surfaces inclined so as to separate outward from the rotation axis of the fan, with these inclined surfaces being disposed apart from each other in the direction in which the rotation shaft extends.

In this outdoor unit of a refrigeration cycle apparatus, the flat-shaped locations of the top end edge of the casing can be used as mounting locations when stacking a plurality of the outdoor units vertically. Therefore, it is possible to stably arrange a plurality of outdoor units vertically, while securing a storage location becomes easy. In the outdoor unit, the diffuser surface is provided below the top end edge of the casing but above the top end of the bellmouth and on the outer side relative to the top end of the bellmouth in plan view. For this reason, the airflow that has passed through the flow passage formed by the bellmouth, at the stage prior to passing through the larger flow passage formed by the outlet of the casing, flows through the flow passage formed by the diffuser surface where the passage area is smoothly enlarged. As a result, it is possible to avoid the airflow passage area that suddenly enlarges immediately after the airflow passes through the bellmouth, to reduce the generation of air vortices immediately after the airflow passes through the bellmouth, and to bring good air flow. Thereby, the outdoor unit is not only easily arranged so as to be vertically stacked, but also enables an increase in air volume.

An outdoor unit of a refrigeration cycle apparatus according to one or more embodiments of the outdoor unit of a refrigeration cycle apparatus is the outdoor unit of a refrigeration cycle apparatus according to the previously-described embodiments of the outdoor unit of a refrigeration cycle apparatus, in which the diffuser surfaces spread out to the top end edge of the casing.

In this outdoor unit of a refrigeration cycle apparatus, the diffuser surface is provided so as to spread outward to the top end edge of the casing. For this reason, it is possible to widely secure the diffuser surface up to the vicinity of the side surface of the casing in plan view, and so it is possible to further increase the air volume.

Note that when for example a mesh (e.g., a wire mesh) is provided at the top end outlet of the casing, an effect of reducing the pressure loss when the airflow hits the mesh can be obtained.

An outdoor unit of a refrigeration cycle apparatus according to one or more embodiments of the outdoor unit of a refrigeration cycle apparatus is the outdoor unit of a refrigeration cycle apparatus according to the previously-described embodiments of the outdoor unit of a refrigeration cycle apparatus, in which the casing has side surface that cover the side of the bellmouth. The side surface and the diffuser surface are integrally formed.

In this outdoor unit of a refrigeration cycle apparatus, since the side surface and the diffuser surface are integrally formed, there is no need to affix both with screws (and the number of parts can be reduced due to the omission of the screws), the installation work can be simplified, and it is possible to improve the design property by not using screws.

An outdoor unit of a refrigeration cycle apparatus according to one or more embodiments of the outdoor unit of a refrigeration cycle apparatus is the outdoor unit of a refrigeration cycle apparatus according to the previously-described embodiments of the outdoor unit of a refrigeration cycle apparatus, in which the casing has a side surface that covers a side of the bellmouth. A member having the side surface and a member having the diffuser surface are separate members. The member having the side surface and the member having the diffuser surface are affixed at the upper portion of the casing by screws that extend in the vertical direction.

In this outdoor unit of a refrigeration cycle apparatus, the member having the side surface and the member having the diffuser surface are separate members, but the member having the side surface and the member having the diffuser surface are affixed at the upper portion of the casing by screws that extend in the vertical direction. Therefore, it is possible to provide a structure in which the screws are hard to see from the side of the casing, and it is possible to enhance the appearance of the casing from the side.

An outdoor unit of a refrigeration cycle apparatus according to one or more embodiments of the outdoor unit of a refrigeration cycle apparatus is the outdoor unit of a refrigeration cycle apparatus according to the previously-described embodiments of the outdoor unit of a refrigeration cycle apparatus, in which the casing has a plurality of side surfaces that cover the sides of the bellmouth. At least one of the side surfaces has a recessed shape toward the bellmouth so that the gap with the top end edge of the bellmouth is reduced.

In this outdoor unit of a refrigeration cycle apparatus, a side surface is provided that has a shape that is recessed toward the bellmouth. For this reason, at the portion with the shape recessed toward the bellmouth, it is possible to avoid a sudden enlargement of the flow passage after passage through the bellmouth, and so it is possible to reduce the generation of air vortices after passage through the bellmouth.

An outdoor unit of a refrigeration cycle apparatus according to one or more embodiments of the outdoor unit of a refrigeration cycle apparatus is the outdoor unit of a refrigeration cycle apparatus according to the previously-described embodiments of the outdoor unit of a refrigeration cycle apparatus, further provided with connecting surface. The connecting surface extends vertically downward from the bottom ends of the diffuser surface to the top end edge of the bellmouth.

Extending to the top end edge of the bellmouth may mean extending to the extent of overlapping with the flow passage forming portion at the downstream side of the bellmouth, and there is no need to be in contact with the top end of the bellmouth. Also, the connecting surface needs not extend downward from the entire bottom end of the diffuser surface, but rather may extend downward from a part of the bottom end of the diffuser surface.

In this outdoor unit of a refrigeration cycle apparatus, the airflow after having passed through the bellmouth can be guided in the vertical direction at the flow passage portion formed by the connecting surface extending in the vertical direction, at the stage prior to being sent to the diffuser surface. Thereby, since it is possible to secure in the flow passage of air a portion that flows the air in the vertical direction, it is possible to further increase the air volume.

An outdoor unit of a refrigeration cycle apparatus according to one or more embodiments of the outdoor unit of a refrigeration cycle apparatus is the outdoor unit of a refrigeration cycle apparatus according to the previously-described embodiments of the outdoor unit of a refrigeration cycle apparatus, in which the diffuser surface is flat surface.

In this outdoor unit of a refrigeration cycle apparatus, since the diffuser surface is flat surface, processing during manufacture is easy.

In the outdoor unit of a refrigeration cycle apparatus according to one or more embodiments, the outdoor unit is not only easily arranged so as to be vertically stacked but also enables an increase in air volume.

In the outdoor unit of a refrigeration cycle apparatus according to one or more embodiments, it is possible to widely secure diffuser surface up to the vicinity of the side surface of the casing in plan view, and so it is possible to further increase the air volume.

In the outdoor unit of a refrigeration cycle apparatus according to one or more embodiments, fastening work with screws is unnecessary, and so the design property can be improved.

In the outdoor unit of a refrigeration cycle apparatus according to one or more embodiments, it is possible to enhance the appearance of the casing from the side.

In the outdoor unit of a refrigeration cycle apparatus according to one or more embodiments, at the portion with the shape recessed toward the bellmouth, it is possible to avoid a sudden enlargement of the flow passage after passage through the bellmouth, and so it is possible to reduce the generation of air vortices after passage through the bellmouth.

In the outdoor unit of a refrigeration cycle apparatus according to one or more embodiments, it is possible to secure in the flow passage of air a portion that flows the air in the vertical direction, and so it is possible to further increase the air volume.

In the outdoor unit of a refrigeration cycle apparatus according to one or more embodiments, processing during manufacture is easy.

DETAILED DESCRIPTION

Hereinbelow, embodiments of an outdoor unit for refrigeration cycle apparatus and modifications thereof will be described with reference to the drawings. Concrete configurations of the outdoor unit for refrigeration cycle apparatus are not limited to the following embodiments and modifications thereof, and can be modified within a range not deviating from the gist of the invention.

(1) Configuration of Air Conditioner

Figure 1:
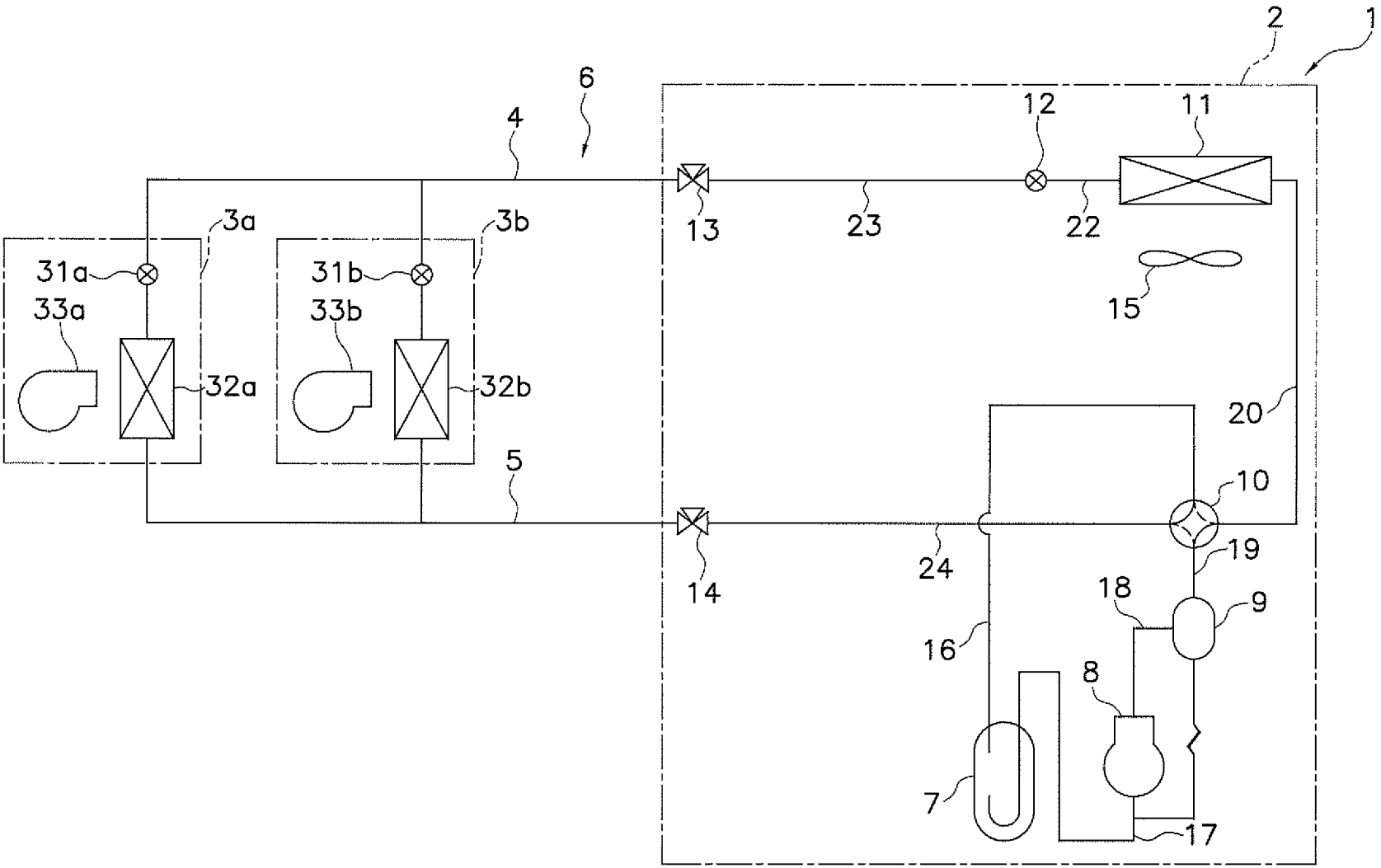
FIG. 1 is a schematic configuration diagram of an air conditioner in which the outdoor unit according to one or more embodiments of the present invention is adopted.

FIG. 1 is a schematic configuration diagram of an air conditioner 1 in which an outdoor unit 2 according to one or more embodiments is adopted.

The air conditioner 1 is a device capable of performing cooling and heating inside a building or the like by performing a vapor compression-type refrigeration cycle. The air conditioner 1 is mainly constituted by connecting the outdoor unit 2 and indoor units 3*a* and 3*b*. Here, the outdoor unit 2 and the indoor units 3*a*, 3*b* are connected via a liquid refrigerant communication tube 4 and a gas refrigerant communication tube 5. That is, a vapor compression-type refrigerant circuit 6 of the air conditioner 1 is configured such that the outdoor unit 2 and the indoor units 3*a*, 3*b* are connected via the refrigerant communication tubes 4, 5.

The outdoor unit 2 is installed outdoors (on the roof of a building, in the vicinity of a wall of a building), and constitutes a part of the refrigerant circuit 6. The outdoor unit 2 mainly includes an accumulator 7, a compressor 8, an oil separator 9, a four-way switching valve 10, an outdoor heat exchanger 11, an outdoor expansion valve 12, a liquid-side shutoff valve 13, a gas-side shutoff valve 14, and an outdoor fan 15. The respective devices and valves are connected by refrigerant tubes 16 to 24.

The indoor units 3*a*, 3*b* are installed in the interior (a living space, a ceiling back space or the like), and constitute a part of the refrigerant circuit 6. The indoor unit 3*a* mainly includes an indoor expansion valve 31*a*, an indoor heat exchanger 32*a*, and an indoor fan 33*a*. The indoor unit 3*b* mainly includes an indoor expansion valve 31*b*, an indoor heat exchanger 32*b*, and an indoor fan 33*b*.

The refrigerant communication tubes 4, 5 are refrigerant tubes to be assembled on site when the air conditioner 1 is installed in the place of installation of a building or the like. One end of the liquid refrigerant communication tube 4 is connected to the liquid-side shutoff valve 13 of the outdoor unit 2, and the other end of the liquid refrigerant communication tube 4 is connected to the liquid-side end of the indoor expansion valves 31*a*, 31*b* of the indoor units 3*a*, 3*b*. One end of the gas refrigerant communication tube 5 is connected to the gas side shutoff valve 14 of the outdoor unit 2, and the other end of the gas refrigerant communication tube 5 is connected to the gas-side end of the indoor heat exchangers 32*a*, 32*b* of the indoor units 3*a*, 3*b*.

(2) Overall Configuration of Outdoor Unit

Figure 2:
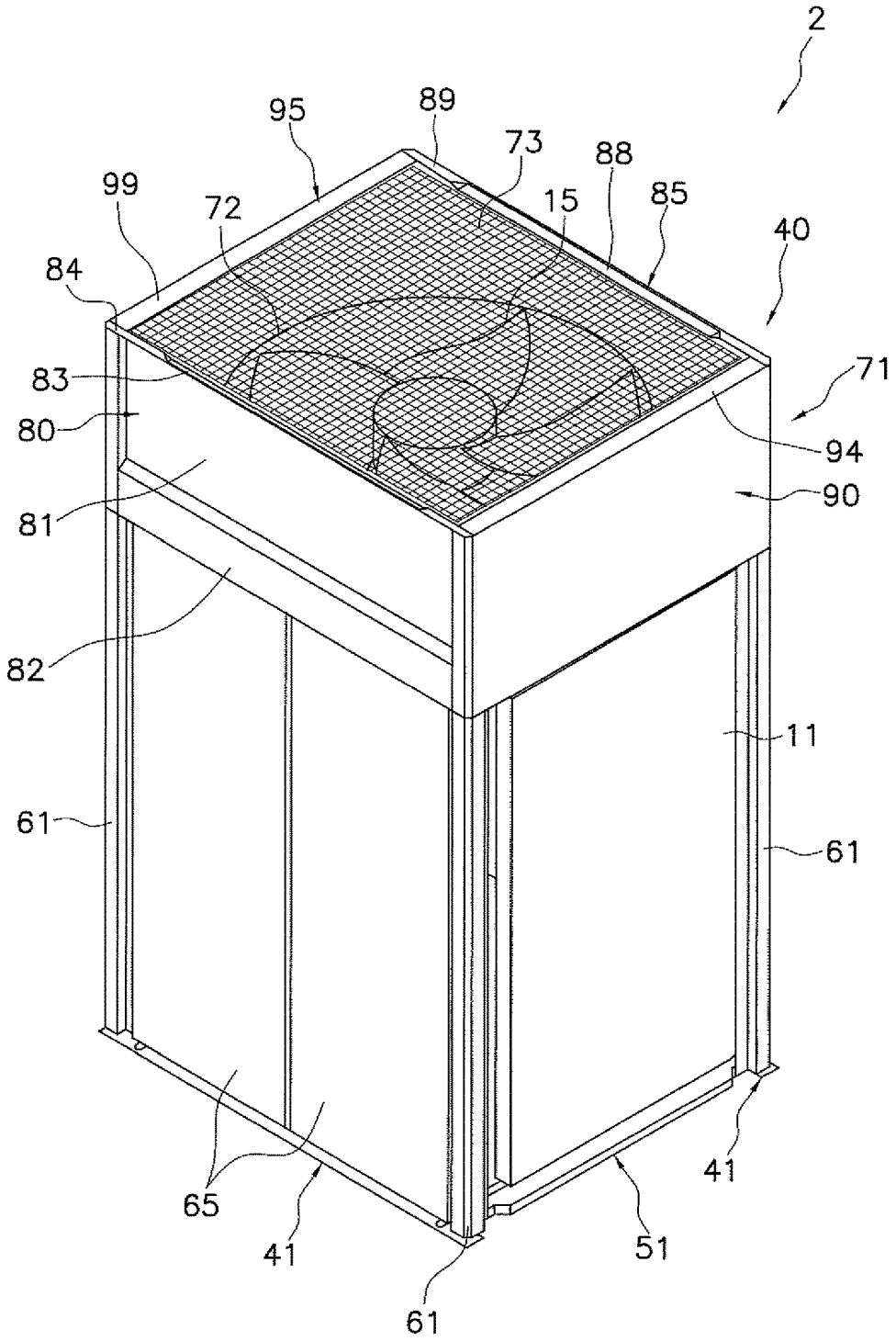
FIG. 2 is an external perspective view of the outdoor unit.
Figure 3:
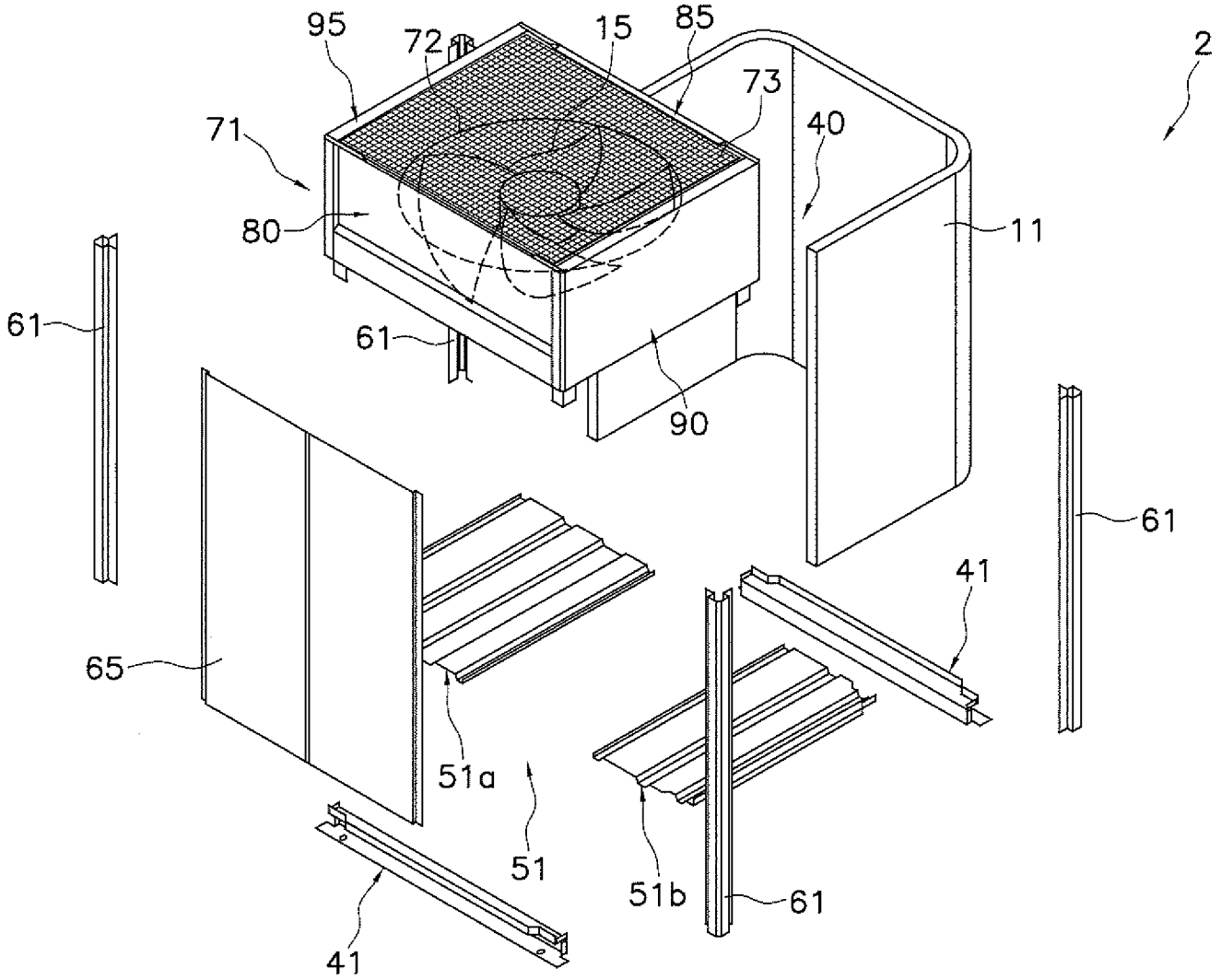
FIG. 3 is an exploded perspective view of the casing, the outdoor heat exchanger, and the fan module of the outdoor unit.

FIG. 2 is an external perspective view of the outdoor unit 2. FIG. 3 is an exploded perspective view of the casing 40, the outdoor heat exchanger 11, and a fan module 71 of the outdoor unit 2.

In the following description, "top", "bottom", "left", "right", "front", "rear", "front surface", "back surface" refer to directions when the outdoor unit 2 shown in FIG. 2 is viewed from the front (the left front of the drawing), unless otherwise specifically noted.

The outdoor unit 2 is one that is called an up-flow type structure that takes in air from the bottom of the casing 40 and blows air out from the top of the casing 40. The outdoor unit 2 mainly includes the casing 40 having a substantially rectangular parallelepiped box shape, a right diffuser surface 91, a right vertically curved surface 92, a left diffuser surface 96, a left vertically curved surface 97, a fan module 71, a blowout grill 73, and refrigerant circuit constituent parts constituting a part of the refrigerant circuit 6. The refrigerant circuit constituent parts of the outdoor unit 2 include the compressor 8, the outdoor heat exchanger 11, the accumulator 7, the oil separator 9, the four-way switching valve 10, the outdoor expansion valve 12, the liquid-side shutoff valve 13, the gas-side shutoff valve 14, and the refrigerant tubes 16 to 24.

The casing 40 mainly has a bottom frame 51 disposed over a pair of mounting legs 41 extending in the left-right direction, support columns 61 extending in a vertical direction from corners of the bottom frame 51 respectively, a front panel 65, a front air-blowing side plate 80, a rear air-blowing side plate 85, a right side surface 93, a right mounting surface 94, a left side surface 98, and a left mounting surface 99. The front air-blowing side plate 80 covers the front side of the fan module 71. The rear air-blowing side plate 85 covers the rear side of the fan module 71. The right side surface 93 covers the right side of the fan module 71. The right mounting surface 94 constitutes a part of the top end edge of the casing 40 and is a surface that extends horizontally from the top end edge of the right side surface 93 toward the inside (left side). The left side surface 98 covers the left side of the fan module 71. The left mounting surface 99 constitutes a part of the top end edge of the casing 40 and is a surface that extends horizontally from the top end edge of the left side surface 98 toward the inside (right side).

The bottom frame 51 forms the bottom surface of the casing 40, with the outdoor heat exchanger 11 being provided on the bottom frame 51. The bottom frame 51 may be constituted as a combination of a left-side first bottom frame 51*a* and a right-side second bottom frame 51*b*. Here, the outdoor heat exchanger 11 is a heat exchanger that is substantially U-shaped, in plan view, facing the back surface and both the left and right side surfaces of the casing 40, and thereby substantially forms the back surface and the left and right side surfaces of the casing 40. The outdoor heat exchanger 11 is disposed so as to extend along the upper side of the left edge, the rear edge, and the right edge of the bottom frame 51.

The front panel 65 is bridged between the support columns 61 on the front side below the fan module 71 and thereby forms the front surface of the casing 40.

The casing 40 also accommodates refrigerant circuit components other than the outdoor fan 15 and the outdoor heat exchanger 11. Here, the compressor 8 is a device for compressing the refrigerant, and is provided on the bottom frame 51. The accumulator 7 is a refrigerant container for temporarily storing the refrigerant before being sucked into the compressor 8, and is provided on the bottom frame 51. The oil separator 9 is a device for separating the refrigerant oil from the refrigerant discharged from the compressor 8, and is provided on the bottom frame 51.

The right diffuser surface 91 is provided below the top end edge of the casing 40 but above the top end of a bellmouth 72 and on the outer side relative to the top end of the bellmouth 72 in plan view, and the right diffuser surface 91 is also inclined so as to separate outward away from the rotation axis 75 of the outdoor fan 15 heading upward. More specifically, the right diffuser surface 91 is a flat, sloping surface that, in plan view, extends obliquely downward from the inner edge (left edge) of the right mounting surface 94 toward the inside (slightly above the right edge of the top end of the bellmouth 72).

The right vertically curved surface 92 is a curved surface extending from the bottom end edge of the right diffuser surface 91 further downward in the vertical direction to the vicinity of the right-side top end of the bellmouth 72.

Figure 9:
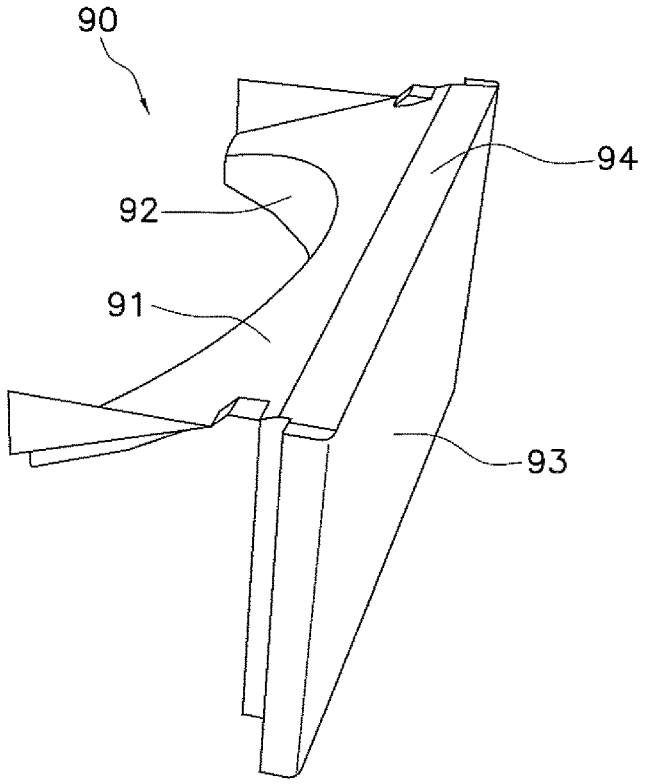
FIG. 9 is schematic external perspective view of the right air-blowing side plate.

As shown in FIG. 9, the right diffuser surface 91, the right vertically curved surface 92, the right side surface 93, and the right mounting surface 94 may be constituted as a right air-blowing side plate 90 that is a single sheet metal member.

The left diffuser surface 96, similarly to the right diffuser surface 91, is provided below the top end edge of the casing 40 but above the top end of the bellmouth 72 and on the outer side relative to the top end of the bellmouth 72 in plan view, and the left diffuser surface 96 is also inclined so as to separate outward away from the rotation axis 75 of the outdoor fan 15 heading upward. More specifically, the left diffuser surface 96 is a flat, sloping surface that, in plan view, extends obliquely downward from the inner edge (right edge) of the left mounting surface 99 toward the inside (slightly above the left edge of the top end of the bellmouth 72).

The left vertically curved surface 97 is a curved surface extending from the bottom end edge of the left diffuser surface 96 further downward in the vertical direction to the vicinity of the left-side top end of the bellmouth 72.

The left diffuser surface 96, the left vertically curved surface 97, the left side surface 98, and the left mounting surface 99 may be constituted as a left air-blowing side plate 95 that is a single sheet metal member.

The front air-blowing side plate 80, the rear air-blowing side plate 85, the right air-blowing side plate 90, and the left air-blowing side plate 95 may be each constituted as separate members made of sheet metal.

The fan module 71 is provided on the upper side of the outdoor heat exchanger 11, and has the bellmouth 72 and the outdoor fan 15. The bellmouth 72 is attached to the top ends of the four support columns 61. Like the bottom frame 51, the lower portion of the bellmouth 72 has a rectangular shape in a plan view, and the upper portion of the bellmouth 72 has a cylindrical shape whose axial direction is the vertical direction. The cylindrical shape at the upper portion of the bellmouth 72 is positioned to the inside of the rectangular shape of the lower portion in plan view. The cylindrical portion at the upper portion of the bellmouth 72 covers the outdoor fan 15 from the surroundings and constitutes a part of the flow passage of the airflow. The rectangular shape at the lower portion of the bellmouth 72 and the cylindrical shape at the upper portion are smoothly connected via curved surface. The outdoor fan 15 is arranged inside the cylindrical shape, which is the upper portion of the bellmouth 72, in an orientation such that the direction of extension of the rotation shaft 75 is the vertical direction (see FIG. 7). The outdoor fan 15 is driven and controlled by being connected to a fan motor that is not illustrated.

The front side of this fan module 71 is covered with the front air-blowing side plate 80, the rear side by the rear air-blowing side plate 85, the right side by the right side surface 93, and the left side by the left side surface 98. The front air-blowing side plate 80, the rear air-blowing side plate 85, the right side surface 93, and the left side surface 98 constitute a substantially rectangular parallelepiped-shaped box of which the top and bottom are open, and houses therein the bellmouth 72 and the outdoor fan 15.

The front air-blowing side plate 80, the rear air-blowing side plate 85, the right side surface 93, and the left side surface 98 are all affixed to the support columns 61 and constitute the upper portions of the support columns 61 in the casing 40. In addition, the front air-blowing side plate 80, the rear air-blowing side plate 85, the right side surface 93, and the left side surface 98 are screw-affixed to each other in the vicinity of the front, rear, left, and right end portions.

With the above structure, the front air-blowing side plate 80, the rear air-blowing side plate 85, the right diffuser surface 91, the right vertically curved surface 92, the left diffuser surface 96, and the left vertically curved surface 97 form a flow passage that guides the airflow upward, above the cylindrical portion at the upper portion of the bellmouth 72 (on the downstream side of the airflow F (see FIG. 10, FIG. 11)).

Note that, at the upper part of the fan module 71, a diffuser is constituted mainly by the right diffuser surface 91 and the left diffuser surface 96, and secondarily by a front inclined surface 83 that is part of the front air-blowing side plate 80 and a rear inclined surface 88 that is a part of the rear air-blowing side plate 85.

In addition, the blowout grill 73, which extends on a plane, is provided at the outlet above the casing 40 (above the diffuser). The blowout grill 73 is not particularly limited, but a metal wire mesh can be used.

(3) Structure of Upper Portion of the Casing of the Outdoor Unit

Figure 4:
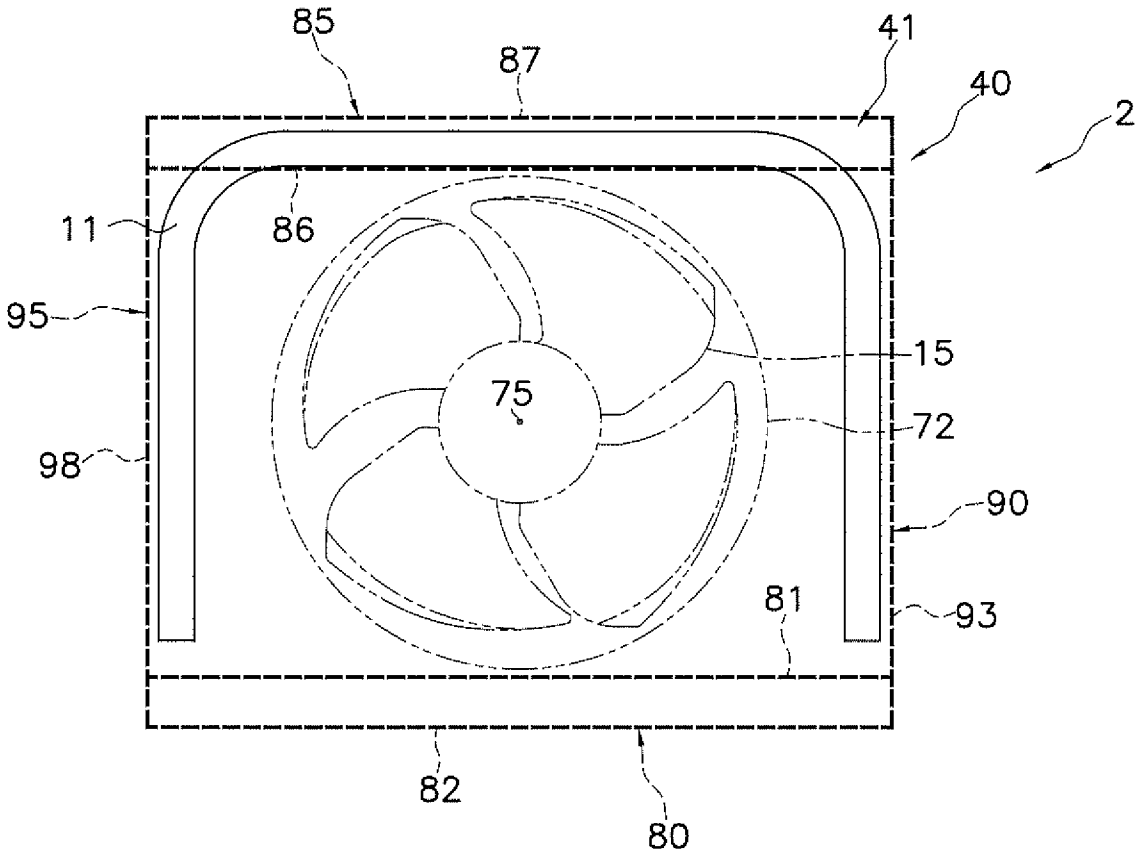
FIG. 4 is a plan view illustrating the positional relationship between the outdoor heat exchanger, the outdoor fan, and the casing.
Figure 5:
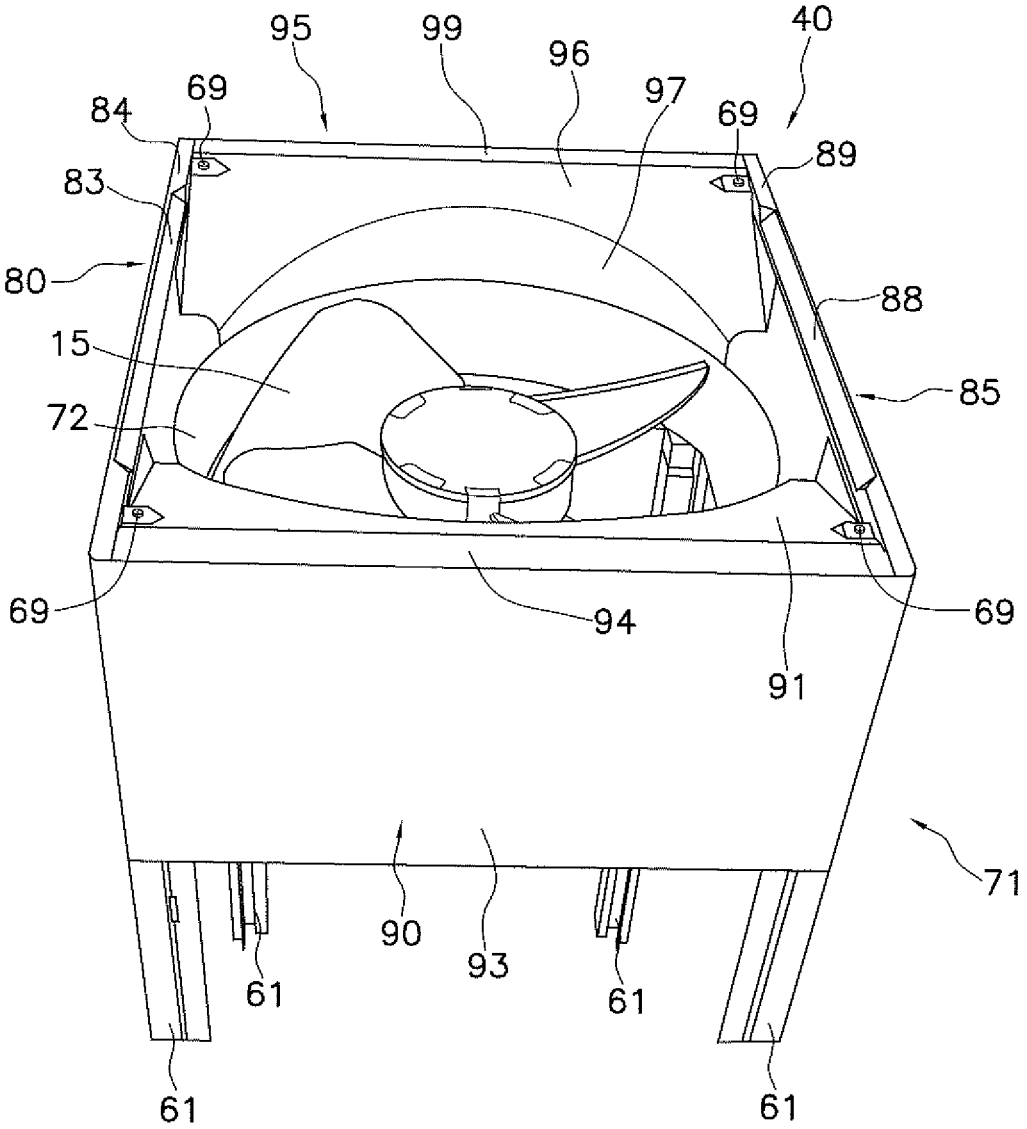
FIG. 5 is an external schematic perspective view of the upper portion of the casing, the right diffuser surface, the left diffuser surface, the left vertically curved surface, and the fan module viewed from the upper right (in the state excluding the blowout grill).
Figure 6:
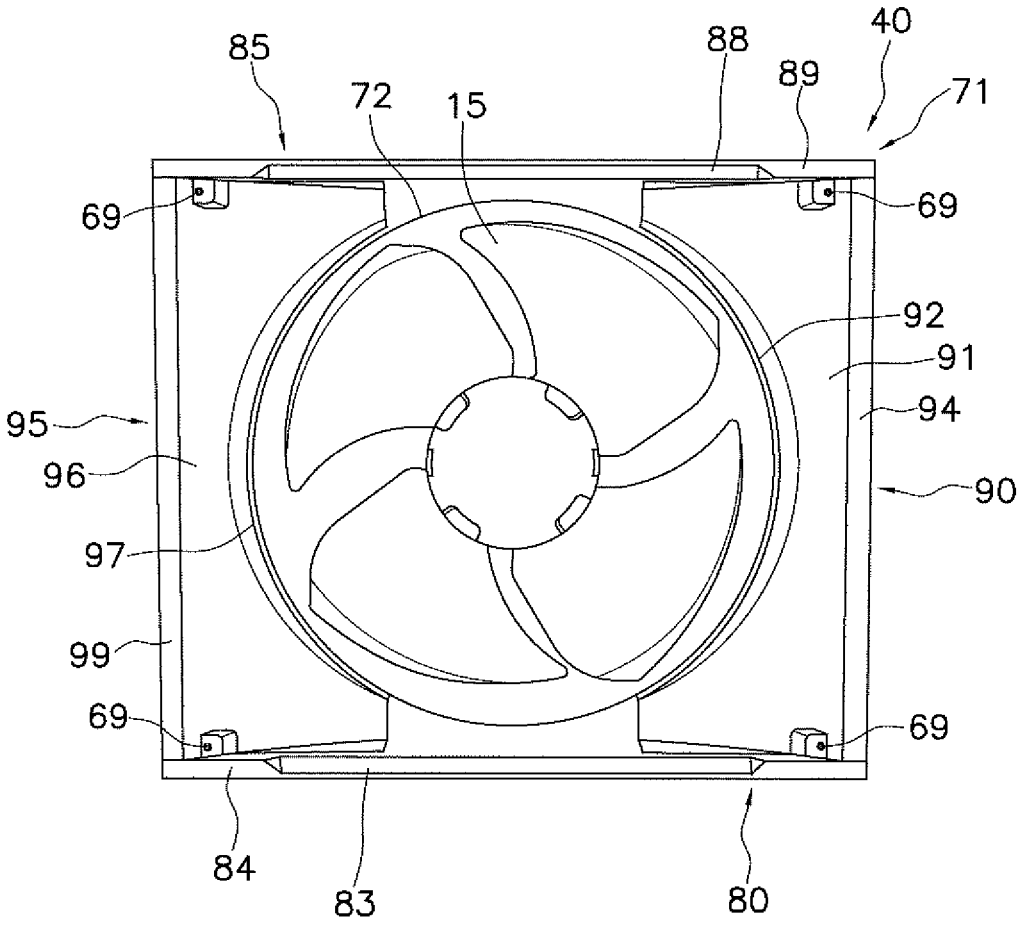
FIG. 6 is an external schematic plan view of the upper portion of the casing, the right diffuser surface, the right vertically curved surface, the left diffuser surface, the left vertically curved surface, and the fan module viewed from above (in the state excluding the blowout grill).
Figure 7:
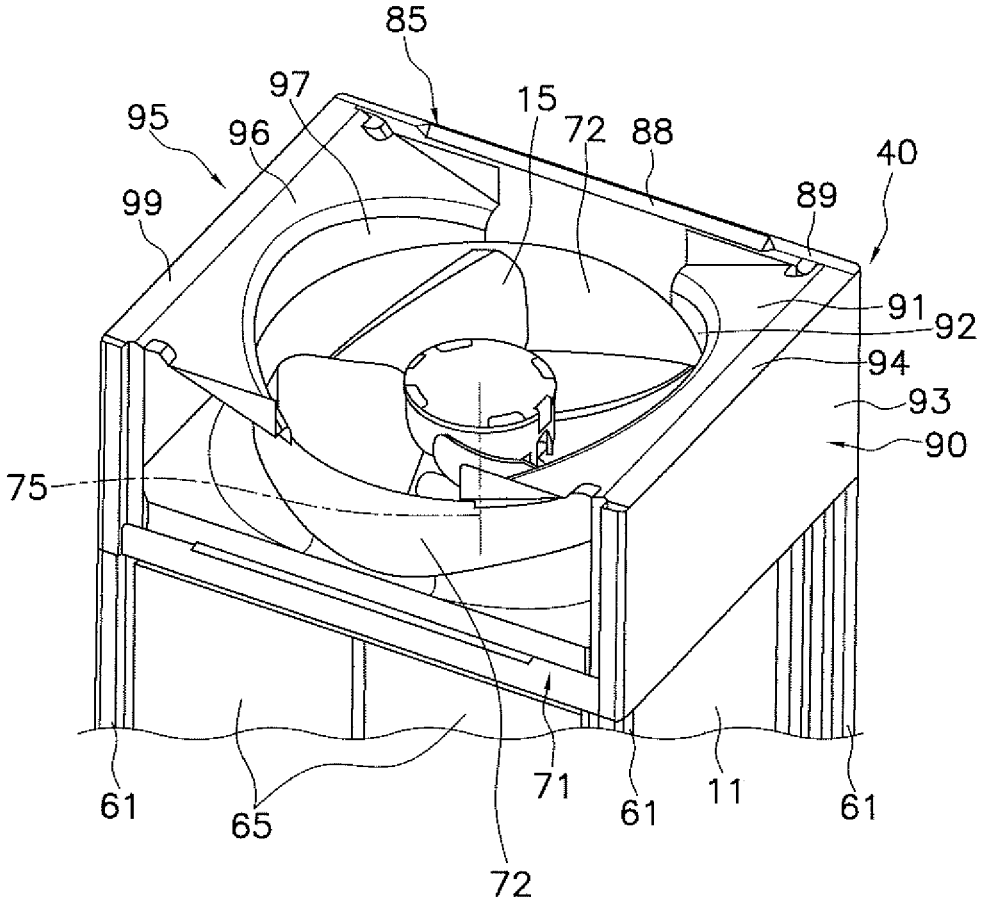
FIG. 7 is an external schematic perspective view of the upper vicinity of the casing, the right diffuser surface, the right vertically curved surface, the left diffuser surface, the left vertically curved surface, and the fan module viewed diagonally forward right (in the state excluding the blowout grill and the front air-blowing side plate).
Figure 8:
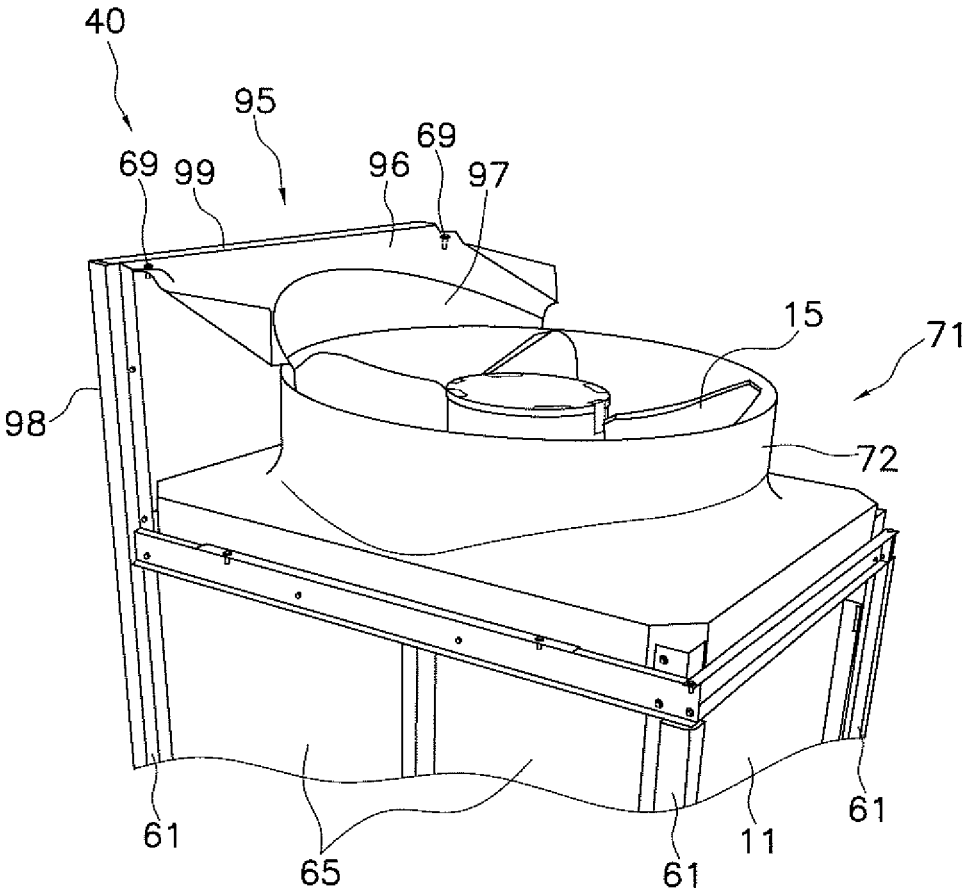
FIG. 8 is an external schematic perspective view of the upper vicinity of the casing, the left diffuser surface, the left vertically curved surface, and the fan module viewed diagonally forward right (in the state excluding with the blowout grill, the front air-blowing side plate, the rear air-blowing side plate, the right side surface, and the right mounting surface).
Figure 10:
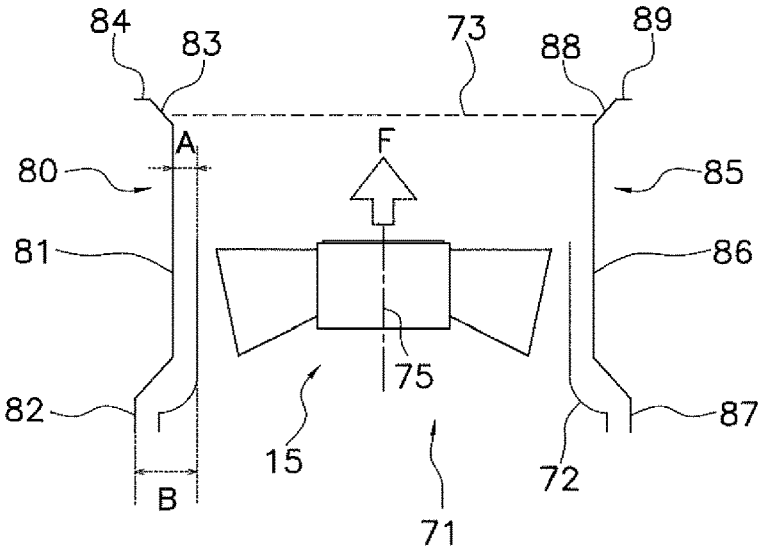
FIG. 10 is a drawing illustrating the positional relationship in a front-rear cross section including the rotation axis of the outdoor fan.
Figure 11:
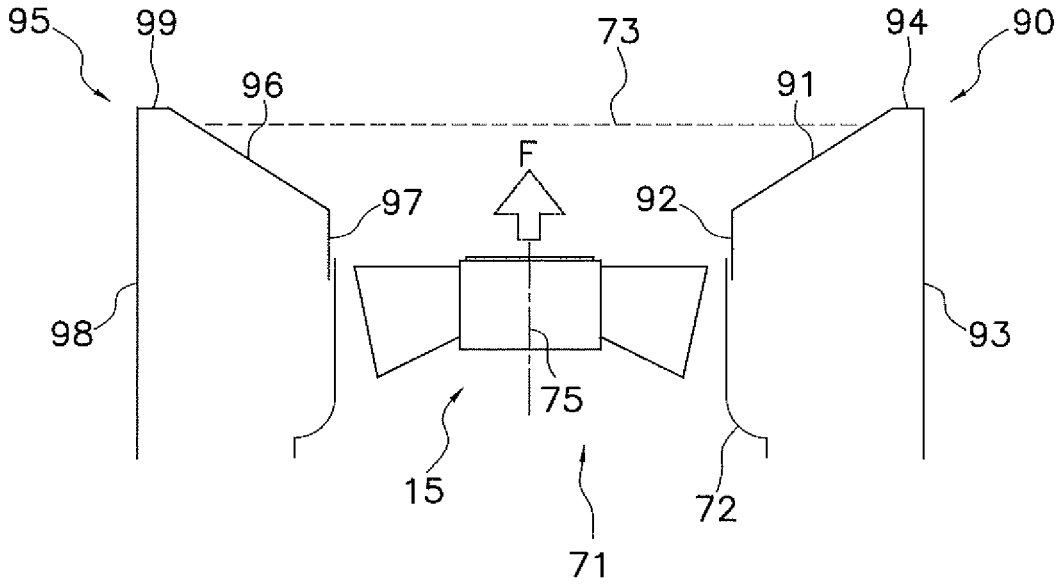
FIG. 11 is a drawing illustrating the positional relationship in a left-right cross section including the rotation axis of the outdoor fan.

FIG. 4 is a plan view illustrating the positional relationship between the outdoor heat exchanger 11, the outdoor fan 15, and the casing 40. FIG. 5 is an external schematic perspective view of the upper portion of the casing 40, the right diffuser surface 91, the left diffuser surface 96, the left vertically curved surface 97, and the fan module 71 viewed from the upper right (in the state excluding the blowout grill 73). FIG. 6 is an external schematic plan view of the upper vicinity of the casing 40, the right diffuser surface 91, the right vertically curved surface 92, the left diffuser surface 96, the left vertically curved surface 97, and the fan module 71 viewed from above (in the state excluding the blowout grill 73). FIG. 7 is an external schematic perspective view of the upper vicinity of the casing 40, the right diffuser surface 91, the right vertically curved surface 92, the left diffuser surface 96, the left vertically curved surface 97, and the fan module 71 viewed diagonally forward right (in the state excluding the blowout grill 73 and the front air-blowing side plate 80). FIG. 8 is an external schematic perspective view of the upper vicinity of the casing 40, the left diffuser surface 96, the left vertically curved surface 97, and the fan module 71 viewed diagonally forward right (in the state excluding the blowout grill 73, the front air-blowing side plate 80, the rear air-blowing side plate 85, the right side surface 93, and the right mounting surface 94). FIG. 9 is schematic external perspective view of the right air-blowing side plate 90. FIG. 10 is a drawing illustrating the positional relationship in a front-rear cross section including the rotation axis 75 of the outdoor fan 15. FIG. 11 is a drawing illustrating the positional relationship in a left-right cross section including the rotation axis 75 of the outdoor fan 15.

As described above, the front, rear, left and right sides of the bellmouth 72 are respectively covered with the front air-blowing side plate 80, the rear air-blowing side plate 85, the right side surface 93, and the left side surface 98.

The front air-blowing side plate 80 and the rear air-blowing side plate 85 have symmetrical shapes in the front-rear direction, and the right air-blowing side plate 90 (the member constituted by the right diffuser surface 91, the right vertically curved surface 92, the right side surface 93, and the right mounting surface 94) and the left air-blowing side plate 95 (the member constituted by the left diffuser surface 96, the left vertically curved surface 97, the left side surface 98, and the left mounting surface 99) may have symmetrical shapes in the left-right direction.

The front air-blowing side plate 80 has a front upper surface portion 81, a front lower surface portion 82, a front inclined surface 83, and a front mounting surface 84. The front air-blowing side plate 80 is fabricated by pressing or bending a single plate member. As shown in FIGS. 2, 4, and 10, the front upper surface portion 81 is a planar shaped portion that extends in the up-down and left-right directions so as to cover the front side portion including the front side of the top end edge of the cylindrical portion above the bellmouth 72 and the upper and lower vicinities thereof. The upper portion of the front upper surface portion 81 extends to the top end vicinity of the casing 40. The vicinity of the center in the left-right direction at the top end of the front upper surface portion 81 is, compared to the vicinities of both ends in the left-right direction at the top end of the front upper surface portion 81, positioned lower in order to be continuous with the bottom end portion of the front inclined surface 83. The front upper surface portion 81 has a portion that spreads out in the left-right direction while extending in the vertical direction from the bottom end of the front upper surface portion 81, through a portion above the front side of the top end edge of the cylindrical portion above the bellmouth 72, to the bottom end portion of the front inclined surface 83 further above. As shown in FIGS. 2, 4, and 10, the front lower surface portion 82 is located below the front upper surface portion 81, and is a planar shaped portion that spreads out in the up-down and left-right directions so as to cover the front side of the rectangular portion below the bellmouth 72. The bottom of the front lower surface portion 82 extends to the top end of one of the support columns 61. As shown in FIGS. 2, 5, 6, and 10, the front mounting surface 84 constitutes a part of the top end edge of the casing 40, being a surface that extends in a planar shape such that the normal direction is the vertical direction. The front mounting surface 84 is provided so as to form a border extending in the left-right direction along front side of the top end edge of the casing 40. The rear end of the front mounting surface 84 in the vicinity of both left and right end portions is continuous with the top end of the front upper surface portion 81. Note that the vicinity of the center in the left-right direction of the rear end of the front mounting surface 84 is, compared to the vicinities of both ends in the left-right direction of the rear end, positioned on the front side in order to be continuous with the top end portion of the front inclined surface 83. As shown in FIGS. 2, 5, 6, 10, the front inclined surface 83 is provided so as to connect the center portion in the left-right direction at the rear side of the front mounting surface 84 and the center portion in the left-right direction at the top end of the front upper surface portion 81, and the front inclined surface 83 is inclined so as to separate outward away from the rotation shaft 75 of the outdoor fan 15 heading upward. The front inclined surface 83 is provided along the front edge of the upper opening of the casing 40 so that the lengthwise direction is the left-right direction.

The rear air-blowing side plate 85 has a rear upper surface portion 86, a rear lower surface portion 87, a rear inclined surface 88, and a rear mounting surface 89. The rear air-blowing side plate 85 and the front air-blowing side plate 80 may have symmetrical shapes in the front-rear direction, and use components having common shapes. The rear air-blowing side plate 85 is fabricated by pressing or bending a single plate member. As shown FIGS. 4 and 10, the rear upper surface portion 86 is a planar shaped portion that spreads out in the vertical and left-right directions so as to cover the rear side portion including the rear side of the top end edge of the cylindrical portion above the bellmouth 72 and the upper and lower vicinities thereof. The upper portion of the rear upper surface portion 86 extends to the top end vicinity of the casing 40. Note that the vicinity of the center in the left-right direction at the top end of the rear upper surface portion 86 is, compared to the vicinities of both ends in the left-right direction at the top end of the rear upper surface portion 86, positioned lower in order to be continuous with the bottom end portion of the front inclined surface 83. The rear upper surface portion 86 has a portion that spreads out in the left-right direction while extending in the vertical direction from the bottom end of the rear upper surface portion 86, through a portion above the rear side of the top end edge of the cylindrical portion above the bellmouth 72, to the bottom end portion of the rear inclined surface 88 further above. As shown in FIGS. 4 and 10, the rear lower surface portion 87 is located below the rear upper surface portion 86, and is a planar shaped portion that extends in the up-down and left-right directions so as to cover the rear side of the rectangular portion below the bellmouth 72. The bottom of the rear lower surface portion 87 extends to the top end of one of the support columns 61. As shown in FIGS. 2, 5, 6, and 10, the rear mounting surface 89 constitutes a part of the top end edge of the casing 40, being a surface that extends in a planar shape such that the normal direction is the vertical direction. The rear mounting surface 89 is provided so as to form a border extending in the left-right direction along rear side of the top end edge of the casing 40. The front end of the rear mounting surface 89 in the vicinity of both left and right end portions is continuous with the top end of the rear upper surface portion 86. Note that the vicinity of the center in the left-right direction of the front end of the rear mounting surface 89 is, compared to the vicinities of both ends in the left-right direction of the front end, positioned on the rear side in order to be continuous with the top end portion of the rear inclined surface 88. As shown in FIGS. 5, 6, 7, 10, the rear inclined surface 88 is provided so as to connect the center portion in the left-right direction at the front side of the rear mounting surface 89 and the center portion in the left-right direction at the top end of the rear upper surface portion 86, being inclined so as to separate outward away from the rotation shaft 75 of the outdoor fan 15 heading upward. The rear inclined surface 88 is provided along the rear edge of the upper opening of the casing 40 so that the lengthwise direction is the left-right direction.

As shown in FIGS. 4, 5, 7, 9, the right side surface 93 is a planar shaped surface that covers the right side above the support columns 61 of the casing 40 and the right side portion of the outdoor heat exchanger 11, and extends from the bottom end to slightly above the top end of the bellmouth 72.

As shown in FIGS. 5, 6, 7, 9, the right mounting surface 94, which constitutes a part of the top end edge of the casing 40, extends from the top end of the right side surface 93 toward the inside in the horizontal direction (left side in the horizontal direction), being a surface that spreads out in a flat shape such that the normal direction is the vertical direction. The right mounting surface 94 is provided so as to form a border extending in the front-rear direction along the right side of the top end edge of the casing 40.

As shown in FIGS. 4 and 8, the left side surface 98 is a planar shaped surface that covers the left side above the support columns 61 of the casing 40 and the left side portion of the outdoor heat exchanger 11, and extends from the bottom end to slightly above the top end of the bellmouth 72.

As shown in FIGS. 5, 6, 7, 8, the left mounting surface 99, which constitutes a part of the top end edge of the casing 40, extends from the top end of the left side surface 98 toward the inside in the horizontal direction (right side in the horizontal direction), being a surface that spreads out in a flat shape such that the normal direction is the vertical direction. The left mounting surface 99 is provided so as to form a border extending in the front-rear direction along the left side of the top end edge of the casing 40.

As shown in FIGS. 5, 6, 7, 9, the right diffuser surface 91 is a flat inclined surface that is provided inclined so as to extend downward from the inside (left side) end of the right mounting surface 94 toward the left side. The right diffuser surface 91 spreads so as to cover the space between the right edge of the top end of the bellmouth 72 and the left edge of the right mounting surface 94 in plan view. The bottom end (left end) of the right diffuser surface 91 forms a circular arc shape in plan view so as to follow the right edge of the top end of the bellmouth 72. In addition, the bottom end (left end) of the right diffuser surface 91, when viewed from the left side, has a shape in which the vicinity of the center bulges upward above the top end of the bellmouth 72. In plan view, the right diffuser surface 91 borders a portion of the cylindrical right edge at the upper portion of the bellmouth 72 corresponding to an angle from the center of the cylindrical shape of about 90 degrees to 150 degrees, and is not provided in the vicinity of the front side and the vicinity of the rear side of the cylindrical right portion at the top of the bellmouth 72. The bottom end of the right diffuser surface 91 extends downward to be lower than the bottom end of the front inclined surface 83 of the front air-blowing side plate 80 and the bottom end of the rear inclined surface 88 of the rear air-blowing side plate 85. Most of the right diffuser surface 91 is positioned below the blowout grill 73.

As shown in FIGS. 6, 7, and 9, the right vertically curved surface 92 is a curved surface extending downward in the vertical direction from the arc-shaped portion of the bottom end (left end) of the right diffuser surface 91. That is, the right vertically curved surface 92 constitutes a curved surface along the cylindrical peripheral surface of the upper portion of the bellmouth 72. The bottom end of the right vertically curved surface 92 extends downward to a position overlapping, in the left-right direction, with the right side of the circular arc portion at the top end of the bellmouth 72. The bottom end of the right vertically curved surface 92 extends so as to follow the right edge of the circular arc portion at the top end of the bellmouth 72 while generating a gap of several millimeters with the right edge of the circular arc portion at the top end of the bellmouth 72.

As shown in FIG. 9, the right side surface 93, the right mounting surface 94, the right diffuser surface 91, and the right vertically curved surface 92 constitute a right air-blowing side plate 90 as one member. The right air-blowing side plate 90 is fabricated by pressing or bending of a single sheet member.

As shown in FIGS. 5, 6, 7 and 8, the left diffuser surface 96 is a flat inclined surface that is provided inclined so as to extend downward from the inside (right side) end of the left mounting surface 99 toward the right side. The left diffuser surface 96 spreads so as to cover the space between the left edge of the top end of the bellmouth 72 and the right edge of the left mounting surface 99 in plan view. The bottom end (right end) of the left diffuser surface 96 forms a circular arc shape in plan view so as to follow the left edge of the top end of the bellmouth 72. In addition, the bottom end (left end) of the left diffuser surface 96, when viewed from the right side, has a shape in which the vicinity of the center bulges upward above the top end of the bellmouth 72. In plan view, the left diffuser surface 96 borders a portion of the cylindrical left edge at the upper portion of the bellmouth 72 corresponding to an angle from the center of the cylindrical shape of about 90 degrees to 150 degrees, and is not provided in the vicinity of the front side and the vicinity of the rear side of the cylindrical left portion at the top of the bellmouth 72. The bottom end of the left diffuser surface 96 extends downward to be lower than the bottom end of the front inclined surface 83 of the front air-blowing side plate 80 and the bottom end of the rear inclined surface 88 of the rear air-blowing side plate 85. Most of the left diffuser surface 96 is positioned below the blowout grill 73.

As shown in FIGS. 5, 6, 7 and 8, the left vertically curved surface 97 is a curved surface extending downward in the vertical direction from the arc-shaped portion of the bottom end (right end) of the left diffuser surface 96. That is, the left vertically curved surface 97 constitutes a curved surface along the cylindrical peripheral surface of the upper portion of the bellmouth 72. The bottom end of the left vertically curved surface 97 extends downward to a position overlapping, in the left-right direction, with the left side of the circular arc portion at the top end of the bellmouth 72. The bottom end of the left vertically curved surface 97 extends so as to follow the left edge of the circular arc portion at the top end of the bellmouth 72 while generating a gap of several millimeters with the left edge of the circular arc portion at the top end of the bellmouth 72.

The left side surface 98, the left mounting surface 99, the left diffuser surface 96, and the left vertically curved surface 97 constitute a left air-blowing side plate 95 as one member. The left air-blowing side plate 95 has a symmetrical shape in the left-right direction with the right air-blowing side plate 90, and can use components having common shapes. The left air-blowing side plate 95 is fabricated by pressing or bending a single sheet member.

Although the front air-blowing side plate 80, the rear air-blowing side plate 85, the right air-blowing side plate 90, and the left air-blowing side plate 95 are constituted as separate members, as shown in FIGS. 5, 6, and 8, the front air-blowing side plate 80 has an affixing piece, not illustrated, that extends downward in the vicinity of the left-front side of the left diffuser surface 96, and is threadably affixed to the left diffuser surface 96 by a screw 69 that extends in the vertical direction in the vicinity of the left-front side of the left diffuser surface 96. Thereby, the front air-blowing side plate 80 and the left air-blowing side plate 95 are affixed together. Similarly, the front air-blowing side plate 80 has an affixing piece, not illustrated, that extends downward in the vicinity of the right-front side of the right diffuser surface 91, and is threadably affixed to the right diffuser surface 91 by a screw 69 that extends in the vertical direction in the vicinity of the right-front side of the right diffuser surface 91. Thereby, the front air-blowing side plate 80 and the right air-blowing side plate 90 are affixed together. Similarly, the rear air-blowing side plate 85 has an affixing piece, not illustrated, that extends downward in the vicinity of the left-rear side of the left diffuser surface 96, and is threadably affixed to the left diffuser surface 96 by a screw 69 that extends in the vertical direction in the vicinity of the left-rear side of the left diffuser surface 96. Thereby, the rear air-blowing side plate 85 and the left air-blowing side plate 95 are affixed together. Similarly, the rear air-blowing side plate 85 has an affixing piece, not illustrated, that extends downward in the vicinity of the right-rear side of the right diffuser surface 91, and is threadably affixed to the right diffuser surface 91 by a screw 69 that extends in the vertical direction in the vicinity of the right-rear side of the right diffuser surface 91. Thereby, the rear air-blowing side plate 85 and the right air-blowing side plate 90 are affixed together.

(4) Arrangement Relationship of Upper Part of Casing of Outdoor Unit

As shown in FIG. 4, the front lower surface portion 82 of the front air-blowing side plate 80, the rear lower surface portion 87 of the rear air-blowing side plate 85, the right side surface 93, and the left side surface 98 are, as viewed from above, positioned to the outside the outdoor heat exchanger 11.

As shown in FIG. 4, the outdoor heat exchanger 11 may be arranged outside the outdoor fan 15 and the arcs of the top end of the bellmouth 72 in plan view.

As shown in FIGS. 4 and 10, the front upper surface portion 81 of the front air-blowing side plate 80 is located to the inner side (rear side) of the front lower surface portion 82 of the front air-blowing side plate 80. That is, as shown in FIG. 10, the distance A in the front-rear direction between the front upper surface portion 81 of the front air-blowing side plate 80 and the upper front end of the bellmouth 72 (the shortest distance in the front-rear direction) is constituted to be shorter than the distance B in the front-rear direction between the lower surface portion 82 of the front air-blowing side plate 80 and the upper front end of the bellmouth 72 (the shortest distance in the front-rear direction). In this way, by the front upper surface portion 81 being positioned to the rear of the front lower surface portion 82, the front air-blowing side plate 80 has a shape that is recessed toward the rear so as to approach the front portion of the top end of the bellmouth 72.

As shown in FIGS. 4 and 10, the rear upper surface portion 86 of the rear air-blowing side plate 85 is similarly located to the inner side (front side) of the rear lower surface portion 87 of the rear air-blowing side plate 85. That is, as shown in FIG. 10, the distance in the front-rear direction between the rear upper surface portion 86 of the rear air-blowing side plate 85 and the upper rear end of the bellmouth 72 is constituted to be shorter than the distance in the front-rear direction between the rear lower surface portion 87 of the rear air-blowing side plate 85 and the upper rear end of the bellmouth 72.

In this way, by the rear upper surface portion 86 being positioned to the front of the rear lower surface portion 87, the rear air-blowing side plate 85 has a shape that is recessed toward the front so as to approach the rear portion of the top end of the bellmouth 72.

As shown in FIG. 4, in plan view, the distance in the left-right direction from the right side surface 93 to the rotation axis 75 of the outdoor fan 15 (and similarly the distance in the left-right direction from the left side surface 98 to the rotation axis 75 of the outdoor fan 15) is configured to be longer than the distance in the front-rear direction from the front lower surface portion 82 to the rotation axis 75 of the outdoor fan 15 (and similarly the distance in the front-rear direction from the rear lower surface portion 87 to the rotation axis 75 of the outdoor fan 15). Where the distance to the rotation axis 75 of the outdoor fan 15 is long, the right diffuser surface 91 and the left diffuser surface 96 are provided so as to approach the vicinity of the outlet of the bellmouth 72, and where the distance to the rotation axis 75 of the outdoor fan 15 is short, the front upper surface portion 81 and the rear upper surface portion 86 are provided so as to approach the vicinity of the outlet of the bellmouth 72.

The front inclined surface 83 of the front air-blowing side plate 80, the rear inclined surface 88 of the rear air-blowing side plate 85, the right diffuser surface 91, and the left diffuser surface 96 are provided at positions that do not overlap in plan view, and are disposed so as to surround the outer side of the circle at the top end of the bellmouth 72 in plan view.

Note that the front mounting surface 84 of the front air-blowing side plate 80, the rear mounting surface 89 of the rear air-blowing side plate 85, the right mounting surface 94, and the left mounting surface 99 all constitute the top end edge of the casing 40, and are provided so as to extend in the horizontal plane at the same height position.

(5) Characteristics (5-1)

If the airflow flowing out from the flow passage of the cylindrical portion at the top end of the bellmouth 72 is guided to the suddenly enlarged flow passage without providing the right diffuser surface 91 and the left diffuser surface 96, there is a risk of an air vortex being generated in the vicinity of the front or rear of the bellmouth 72 on the downstream side in the airflow direction through the outlet of the bellmouth 72.

In contrast, in the outdoor unit 2 of the air conditioner 1 according to one or more embodiments, on the downstream side in the airflow direction of the top end of the bellmouth 72, the right diffuser surface 91 is provided more on the upstream side in the airflow direction than the outlet of the top end of the casing 40 (the portion surrounded by the inner edges of the front mounting surface 84, the rear mounting surface 89, the right mounting surface 94, and the left mounting surface 99) between the right side surface 93 that covers the right side periphery of the cylindrical portion at the top end of the bellmouth 72 and the right-side portion at the top end of the bellmouth 72. In a similar manner on the left side, on the downstream side in the airflow direction of the top end of the bellmouth 72, the left diffuser surface 96 is provided more on the upstream side in the airflow direction than the outlet of the top end of the casing 40 between the left side surface 98 that covers the left side periphery of the cylindrical portion at the top end of the bellmouth 72 and the left-side portion at the top end of the bellmouth 72.

For this reason, it is possible to avoid the flow passage of the airflow that has passed upward through the top end of the bellmouth 72 from being suddenly enlarged, and instead possible to cause the flow passage of the airflow from the downstream end in the airflow direction of the top end of the bellmouth 72 to the outlet at the top end of the casing 40 to smoothly enlarge.

Thereby, it is possible to reduce the occurrence of air vortices on the downstream side of the bellmouth 72, decrease a reduction of the air volume by the outdoor fan 15, and achieve an increase in the air volume.

In particular, the right diffuser surface 91 and the left diffuser surface 96 of the outdoor unit 2 extend, in plan view, from the top end of the bellmouth 72 outward to the outlet at the top end of the casing 40. For this reason, it is possible to sufficiently enlarge the flow passage between the top end of the bellmouth 72 and the outlet of the casing 40. Thereby, it is possible to obtain a sufficient diffuser effect.

Also, since most of the right diffuser surface 91 and the left diffuser surface 96 are positioned below the blowout grill 73, it is possible to effectively decrease the flow velocity of the airflow by the time the airflow that has passed through the bellmouth 72 has reached the blowout grill 73. Therefore, it is possible to reduce pressure loss caused by the collision of the airflow against the blowout grill 73, decrease a reduction of the air volume formed by the outdoor fan 15, and increase the air volume.

(5-2)

In addition, in the outdoor unit 2 of the air conditioner 1 according to one or more embodiments, the front mounting surface 84 of the front air-blowing side plate 80, the rear mounting surface 89 of the rear air-blowing side plate 85, the right mounting surface 94, and the left mounting surface 99 all constitute the top end edge of the casing 40, and are provided so as to extend in the horizontal plane at the same height position.

Therefore, when storing a plurality of outdoor units 2 in a warehouse or the like, the outdoor units 2 can be vertically stacked and stably arranged in a stacked manner, whereby it is possible to reduce the area of the storage space.

(5-3)

In the outdoor unit 2 of one or more embodiments, among the portions covering the periphery of the bellmouth 72 of the casing 40, in the front air-blowing side plate 80 on the front side, the surface of the front lower surface portion 82 is not extended upward as is, but rather the front upper surface portion 81 is provided by recessing the front air-blowing side plate 80 rearward to be behind the front lower surface portion 82 so as to be positioned closer to the front end of the top end of the bellmouth 72. Similarly, in the rear air-blowing side plate 85 on the rear side, the surface of the rear lower surface portion 87 is not extended upward as is, but rather the rear upper surface portion 86 is provided by recessing the rear air-blowing side plate 85 frontward to be in front of the rear lower surface portion 87 so as to be positioned closer to the rear end of the top end of the bellmouth 72.

In this way, it is possible to reduce the occurrence of air vortices even in the front-rear direction of the bellmouth 72 where the right diffuser surface 91 and the left diffuser surface 96 are not provided, and therefore possible to decrease a reduction in the air volume formed by the outdoor fan 15 and achieve an increase in the air volume.

(5-4)

In the outdoor unit 2 of the air conditioner 1 according to one or more embodiments, not only are the right diffuser surface 91 and the left diffuser surface 96 provided, but the front inclined surface 83, which is inclined so as to be positioned more to the front side the further downstream side of the airflow, is provided in the vicinity of the top end of the front air-blowing side plate 80. Similarly, the rear inclined surface 88, which is inclined so as to be positioned more to the rear side the further downstream of the airflow, is provided in the vicinity of the top end of the rear air-blowing side plate 85.

This makes it possible to further gradually enlarge the flow passage of the airflow before the airflow that has passed through the bellmouth 72 is guided from the top end of the casing 40 to the outside. Thereby, the diffuser effect can be further obtained.

(5-5)

In the outdoor unit 2 of one or more embodiments, the right diffuser surface 91 and the left diffuser surface 96 extend obliquely downward to the vicinity of the circular arc at the top end of the bellmouth 72, and the right vertically curved surface 92 and the left vertically curved surface 97 spread out vertically downward.

Therefore, since it is possible to ensure the length of the portion that causes the airflow that has passed through the bellmouth 72 to advance straight as is prior to reaching the flow passage surrounded by the right diffuser surface 91 and the left diffuser surface 96, it is possible to decrease a reduction of the air volume by the outdoor fan 15 and further increase the air volume.

In addition, the front upper surface portion 81 of the front air-blowing side plate 80 also extends in the vertical direction at the portion of the airflow on the downstream side of the bellmouth 72. Similarly, the rear upper surface portion 86 of the rear air-blowing side plate 85 also extends in the vertical direction at the portion of the airflow on the downstream side of the bellmouth 72. For this reason, since it is possible to secure the length of the portion that causes the airflow that has passed through the bellmouth 72 to advance straight as is, it is possible to decrease a reduction of the air volume by the outdoor fan 15 and further increase the air volume.

(5-6)

In the outdoor unit 2 of one or more embodiments, the right side surface 93 and the right diffuser surface 91 are provided as one member integrally formed. Likewise, both the left side surface 98 and the left diffuser surface 96 are provided as one member integrally formed. Therefore, it is unnecessary to fasten them by screws (the number of parts can be reduced because the screws can be omitted), and so the installation work can be simplified. In addition, it becomes possible to improve the design property in that the elimination of the screws makes it possible enhance the external appearance.

Although the front air-blowing side plate 80, the rear air-blowing side plate 85, the right air-blowing side plate 90, and the left air-blowing side plate 95 are threadably affixed to each other by the screws 69, since the screws 69 are not visible from the side of the casing 40, in this respect as well an improvement in the design property is achieved.

(5-7)

Since the right diffuser surface 91 of the right air-blowing side plate 90 in the outdoor unit 2 and the left diffuser surface 96 of the left air-blowing side plate 95 in the outdoor unit 2 may both have planar shapes, shaping of the members is easy.

(5-8)

In the outdoor unit 2, regarding the distances between the rotation shaft 75 of the outdoor fan 15 and the side surface (the right side surface 93, the left side surface 98, the front lower surface portion 82, the rear lower surface portion 87), where the distance is short, a recessed shape toward the bellmouth 72 side (the front upper surface portion 81 of the front air-blowing side plate 80 and the rear upper surface portion 86 of the rear air-blowing side plate 85) is provided. Where the distance is long between the rotation shaft 75 of the outdoor fan 15 and the side surface, the right diffuser surface 91 and the left diffuser surface 96 are provided.

For this reason, where the distance to the rotation shaft 75 of the outdoor fan 15 is short, a shape deformation that simply recesses the side surface enables the outlet of the bellmouth 72 to be easily followed.

Where the distance to the rotation shaft 75 of the outdoor fan 15 is long, providing the right diffuser surface 91 and the left diffuser surface 96 enables the flow passage to be smoothly enlarged.

(6) Modifications

The above embodiments can be appropriately modified as shown in the following modifications. It should be noted that each modification may be applied in combination with other modifications so long as there is no inconsistency.

(6-1) Modification A

In the above embodiments, the right air-blowing side plate 90 in which the right diffuser surface 91 and the right side surface 93 are integrally formed as one member (and the left air-blowing side plate 95 in which the left diffuser surface 96 and the left side surface 98 are similarly integrally formed as one member) has been described as an example.

Figure 12:
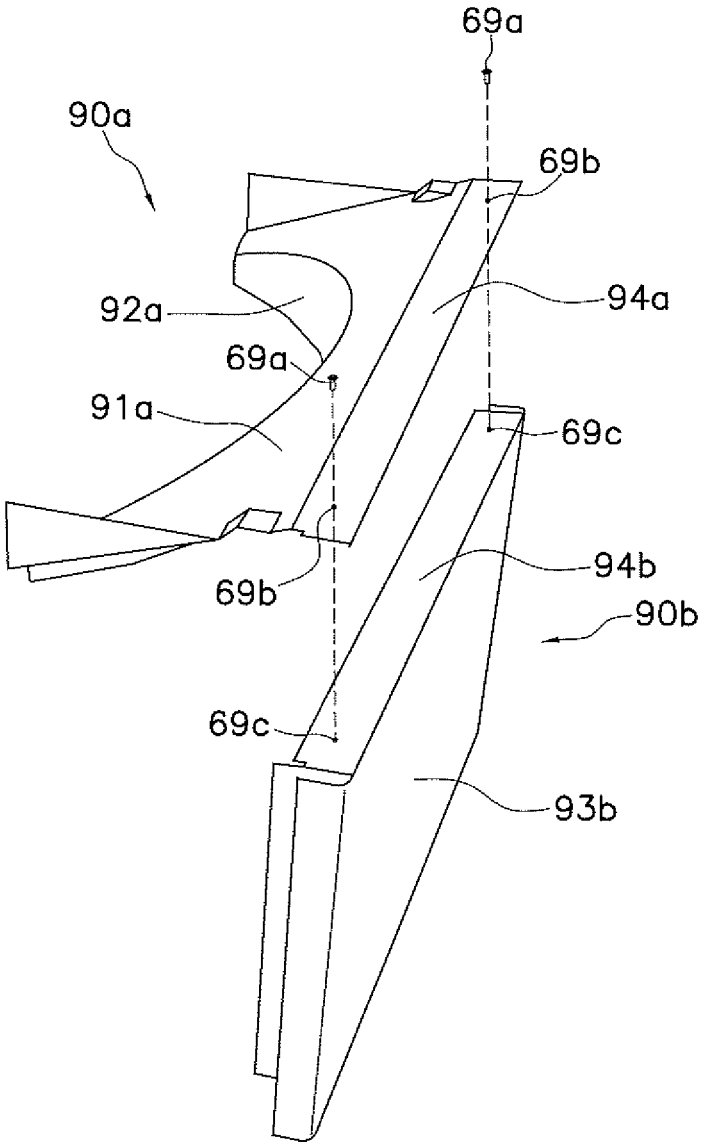
FIG. 12 is a perspective view illustrating an example in which the right diffuser surface and the right side surface according to modification A are separate members.

However, as shown in FIG. 12, a first member 90*a* having a right diffuser surface 91*a*, a right vertically curved surface 92*a*, and a right mounting surface 94*a*, and a second member 90*b* having a right side surface 93 and a joining surface 94*b* may be configured separately as separate members. It should be noted that the first member 90*a* and the second member 90*b* may be threadably affixed together from above by screws 69*a* in a state where the right mounting surface 94*a* and the joining surface 94*b* are overlapped. Also in this case, since the screws 69*a* are not visible from the side of the casing 40, it is possible to enhance the external appearance.

(6-2) Modification B

In the above embodiments, a description was given exemplifying a structure providing a diffuser surface on the right side and the left side of the outlet of the bellmouth 72, and providing the front air-blowing side plate 80 and the rear air-blowing side plate 85 in the front and rear of the bellmouth 72, respectively.

However, the positions at which the diffuser surface is provided are not limited thereto, and for example, a diffuser surface may also be provided on the front side and the rear side of the outlet of the bellmouth 72. That is, on the downstream side of the bellmouth 72, a structure may be adopted that provides a front diffuser surface that is inclined so as to separate outward away from the rotation shaft 75 of the outdoor fan 15 to the front side heading upward, and a rear diffuser surface that is inclined so as to separate outward away from the rotation shaft 75 of the outdoor fan 15 to the rear side heading upward.

Even in this case, the generation of air vortices on the downstream side of the bellmouth 72 can be reduced, and the diffuser effect can also be sufficiently obtained.

Figure 13:
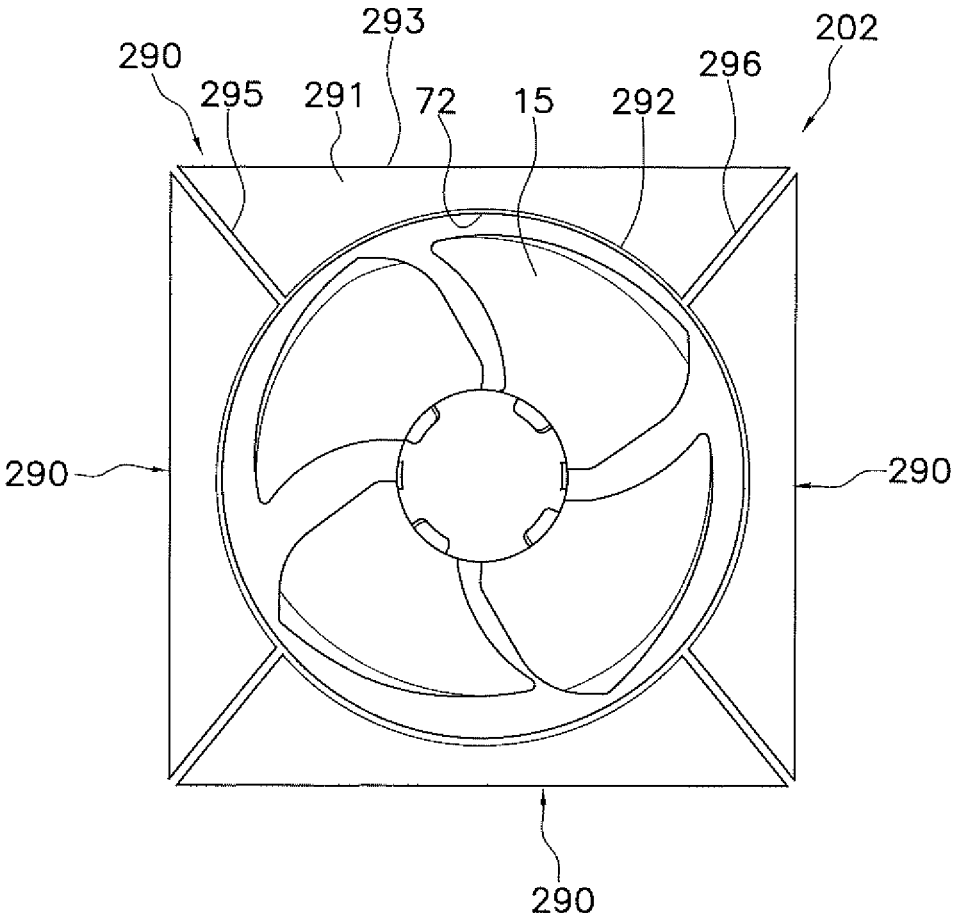
FIG. 13 is a plan view of the outdoor unit according to modification B.
Figure 14:
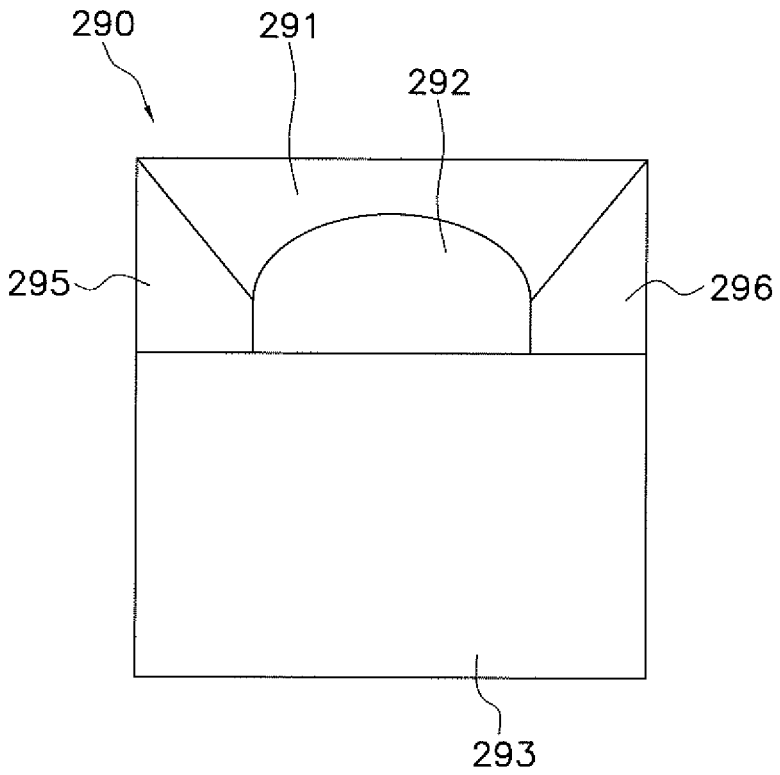
FIG. 14 is a drawing of a common air-blowing side plate according to modification B viewed from the rotation shaft side of the outdoor fan.

In addition, in the case where a diffuser surface is provided in all the front, rear, right and left directions of the bellmouth 72, for example, as shown in FIG. 13, which is a plan view of the outdoor unit 202, and FIG. 14, which is a drawing of a common air-blowing side plate 290 viewed from the rotation shaft 75 of the outdoor fan 15, four of the common air-blowing side plates 290 may be used in combination whereby common members are disposed on the front side, the rear side, the right side, and the left side of the bellmouth 72.

The common air-blowing side plate 290 has a diffuser surface 291 that is inclined so as to separate outward away from the rotation axis 75 of the outdoor fan 15 heading upward, with a vertically curved surface 292 that faces vertically downward being provided so as to follow the circular arc shape of the bellmouth 72 from the central bottom end of the diffuser surface 291. Note that a side surface 293 that spreads vertically downward extends from the top end of the diffuser surface 291. In addition, a first facing surface 295 and a second facing surface 296 are provided so as to sandwich the vertically curved surface 292, so that the common air-blowing side plate 290 can surround the periphery of the bellmouth 72. That is, in the state of the bellmouth 72 being surrounded by four of the common air-blowing side plates 290, the first facing surface 295 of one common air-blowing side plate 290 and the second facing surface 296 of an adjacent common air-blowing side plate 290 are arranged so as to face each other.

Even when using four of these common air-blowing side plates 290 as described above, it is possible to achieve the same effect as the above embodiments.

In the examples shown in FIGS. 13 and 14, mounting surfaces corresponding to the front mounting surface 84, the rear mounting surface 89, the right mounting surface 94, and the left mounting surface 99 are not provided. However, as long as the top end edge of the casing is flat, mounting of outdoor units to be mounted thereon is possible by rotating the outdoor units somewhat in plan view.

(6-3) Modification C

In the above embodiments, the case in which the right diffuser surface 91 and the left diffuser surface 96 extend to the top end edge of the casing 40 was described as an example.

However, the diffuser surface needs only be provided below the top end edge of the casing 40 but above the top end of the bellmouth 72 at positions outside the top end of the bellmouth 72 in plan view, with there being no need for the diffuser surface to extend to the top end edge of the casing 40.

(6-4) Modification D

In the above embodiments, a description was given exemplifying the case in which the lengths in the left-right direction of the front air-blowing side plate 80 and the rear air-blowing side plate 85 in plan view are longer than the lengths in the front-rear direction of the right side surface 93 and the left side surface 98.

However, embodiments of the present invention are not limited thereto, and the lengths in the left-right direction of the front air-blowing side plate 80 and the rear air-blowing side plate 85 and the lengths in the front-rear direction of the right side surface 93 and the left side surface 98 may be made the same. Alternatively, the lengths in the left-right direction of the front air-blowing side plate 80 and the rear air-blowing side plate 85 may be shorter than the lengths in the front-rear direction of the right side surface 93 and the left side surface 98.

(6-5) Modification E

In the above embodiments, a description was given exemplifying the case in which the right diffuser surface 91, which is a flat surface, and the left diffuser surface 96, which is a flat surface, are provided extending to the top end edge of the casing 40.

However, these diffuser surfaces are not limited to flat surface, and may be constituted with curved surface radially expanded so that the flow passage broadens toward the downstream side.

In addition, it is not necessary that these diffuser surface be provided so that flat surface or curved surface continuously spread out from the top end of the bellmouth 72 to the top end edge of the casing 40. For example, a plurality of the diffuser surfaces may be configured such that there exists a plurality of flat or curved diffuser surfaces that are inclined so as to separate outward from the rotation axis 75 of the outdoor fan 15, with these diffuser surfaces disposed apart from each other in the direction in which the rotation shaft 75 of the outdoor fan 15 extends.

One or more embodiments of the present invention can be used for an outdoor unit of a refrigeration cycle apparatus that houses a fan and a bellmouth in a casing.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Air conditioner (refrigeration cycle apparatus)
2 Outdoor unit
7 Accumulator
8 Compressor
9 Oil separator
11 Outdoor heat exchanger (heat exchanger)
15 Outdoor fan (fan)
40 Casing
51 Bottom frame
69*a* Screw
72 Bellmouth
73 Blowout grill
75 Rotation axis
80 Front air-blowing side plate (side surface)
81 Front upper surface portion (recessed shape)
82 Front lower surface portion
83 Front inclined surface
84 Front mounting surface (flat shape)
85 Rear air-blowing side plate (side surface)
86 Rear upper surface portion (recessed shape)
87 Rear lower surface portion
88 Rear inclined surface
89 Rear mounting surface (flat shape)
90 Right air-blowing side plate
90*a* First member (member having the diffuser surface)
90*b* Second member (member having the side surface)
91 Right diffuser surface (diffuser surface)
91*a* Right diffuser surface (diffuser surface)
92 Right vertically curved surface (connecting surface)
92*a* Right vertically curved surface (connecting surface)
93 Right side surface (side surface)
93*b* Right side surface (side surface)
94 Right mounting surface (flat shape)
95 Left air-blowing side plate
96 Left diffuser surface (diffuser surface)
97 Left vertically curved surface (connecting surface)
98 Left side surface (side surface)
99 Left mounting surface (flat surface)
202 Indoor unit
291 Diffuser surface
292 Vertically curved surface (connecting surface)
293 Side surface

CITATION LIST

Patent Literature

[Patent Document 1] Japanese Unexamined Patent Application No. 2014-129921

The invention claimed is:

1. An outdoor unit of a refrigeration cycle apparatus comprising:
- a fan;
- a bellmouth that covers a periphery of the fan;
- a casing that internally houses the fan and the bellmouth so that airflow faces upward and that has a top end edge having a flat shape; and
- a diffuser surface disposed below the top end edge of the casing but above a top end of the bellmouth and on the outer side relative to the top end of the bellmouth in plan view, wherein the diffuser surface is inclined to extend outward away from the rotation axis of the fan as getting upward;

wherein:
- the casing has a side surface that covers a side of the bellmouth;
- the diffuser surface spreads out to the top end edge of the casing;
- the side surface and the diffuser surface are integrally formed so as to form an integrated member;
- the bottoms of the integrated member extend downward to a position overlapping with the top end of the bellmouth; and
- the diffuser surface is inclined from a top of the fan towards the top end edge of the casing.

2. The outdoor unit of a refrigeration cycle apparatus according to claim 1, further comprising a connecting surface that extends vertically downward from the bottoms of the diffuser surface to the top end of the bellmouth.

3. The outdoor unit of a refrigeration cycle apparatus according to claim 1, wherein the diffuser surface is a flat surface.

4. The outdoor unit of a refrigeration cycle apparatus according to claim 1, wherein the diffuser surface is free from discontinuous variation in slope.

5. The outdoor unit according to claim 1, wherein the top end edge extends in a horizontal direction along a top of the casing.

6. The outdoor unit according to claim 1, wherein the top end edge extends in a substantially horizontal direction along a top of the casing.

* * * * *